United States Patent [19]

Mailliet et al.

[11] Patent Number: 4,889,004

[45] Date of Patent: Dec. 26, 1989

[54] APPARATUS FOR DRIVING AN OSCILLATING SPOUT

[75] Inventors: Pierre Mailliet, Howald; Emile Lonardi, Bascharage; Giovanni Cimenti, Fentange, all of Luxembourg

[73] Assignee: Paul Wurth S.A., Luxembourg

[21] Appl. No.: 669,260

[22] Filed: Nov. 7, 1984

[30] Foreign Application Priority Data

Nov. 7, 1983 [LU] Luxembourg ..... 85078

[51] Int. Cl.[4] ..... B05B 3/02; G05G 11/00; F27B 1/20

[52] U.S. Cl. ..... 74/479; 239/227; 414/160; 432/161

[58] Field of Search ..... 74/479; 222/533; 239/227; 432/161; 901/14, 15, 19, 23, 25, 36, 37, 38; 414/160

[56] References Cited

U.S. PATENT DOCUMENTS

| | | | |
|---|---|---|---|
| 3,362,642 | 1/1968 | Freeman et al. | 239/227 X |
| 3,865,424 | 2/1975 | Jabkowski | 901/37 |
| 3,874,595 | 4/1975 | Rindisbacher | 239/227 |
| 4,099,708 | 7/1978 | Morris et al. | 239/227 X |
| 4,306,827 | 12/1981 | Tsutsumi et al. | 414/160 |
| 4,525,120 | 6/1985 | Legille et al. | 414/160 |

FOREIGN PATENT DOCUMENTS 2469683 5/1981 France .

*Primary Examiner*—Allan D. Hermann
*Attorney, Agent, or Firm*—Fishman, Dionne & Cantor

[57] ABSTRACT

An apparatus for driving an oscillating spout capable of pivoting about two orthogonal axes under the action of a pivoting control arm having the same degrees of liberties as the spout is presented. The driving apparatus includes a control mechanism which directs the control arm to perform the movement required by the spout and a transmission device which acts to transmit the control arm movement to the spout to reproduce it as spout movement, and vice versa. The apparatus further includes a rotary internal housing supported on a support frame via a bearing member and enclosed by an outer housing or cowl. The rotary housing is associated with a toothed rim which is actuated by a first motor fixed to or adjacent to the support frame. A control mechanism is also provided which includes a driving rod which is coaxial with the rotary internal housing and which is capable of sliding in the axial direction. The control mechanism is associated with a second motor which is also adjacent to or fixed to the support frame. A pivotal connecting means consisting of a central body and two diametrically opposed pivots is mounted on the lower end of the driving rod via one or more bearings in such a way so as to be freely rotatable in relation to the rod (and in conjunction with the rotary housing) but integral therewith with regard to vertical or axial movement. The pivotal connecting means is associated with the rotary housing such that a high rate of rotation may be transferred thereto.

15 Claims, 2 Drawing Sheets

APPARATUS FOR DRIVING AN OSCILLATING SPOUT

BACKGROUND OF THE INVENTION

This invention relates to the field of drive means for oscillating spouts. More particularly, this invention relates to a new and improved apparatus for driving an oscillating spout for a shaft furnace, the spout being capable of pivoting about two orthogonal axes under the action of a pivoting control arm.

Apparatus of this general type has been described in French Patent Application A-80 13890 corresponding to U.S. Pat. No. 4,306,827, which relates to an apparatus for distribution of charge material in a blast furnace. This French patent application includes an intermediate lever which, together with a control arm, form a rotating hinge having a variable angle of opening (i.e., the included angle). It is this angle of opening which determines the angle of inclination of the control arm and that of the spout in relation to the vertical axis of the furnace. The French patent application also includes a control mechanism which consists essentially of a driving rod capable of pivoting about its longitudinal axis and undergoing axial displacement in order to increase or reduce the "included" angle of the hinge. In order to achieve this action, the driving rod is provided with channel sections for sliding longitudinally therein, under the action of a first motor, inside a rotary socket which is capable of rotating under the action of a second motor.

Unfortunately, the control mechanism of the French patent application is deficient in that relatively high mechanical stresses are concentrated in the position corresponding to the channeled sections. These high stresses have a tendency to render the driving rod immobile in rotation with the outer driving socket. In other words, the stresses will often impede the sliding movement of the rod inside the socket and thereby cause premature wear. Moreover, in order to resist these mechanical stresses, the driving rod of the French patent application must be supported and guided at a plurality of levels; which provides the additional disadvantage of increasing the height of the driving device and of increasing the overall space occupied by the control mechanism.

SUMMARY OF THE INVENTION

The above discussed and other problems of the prior art are overcome or alleviated by the relatively compact driving apparatus for oscillating spouts of the present invention. In accordance with the present invention, a driving apparatus is presented which has a relatively higher resistance to the mechanical stresses as compared to those stresses associated with the driving apparatus disclosed in the French patent application; particularly to those undesirable forces having horizontal components which result from the weight of the oscillating spout.

The present invention provides an apparatus for driving an oscillating spout capable of pivoting about two orthogonal axes under the action of a pivoting control arm having the same degrees of liberties as the spout. An embodiment of the present invention includes a control mechanism which directs the control arm to perform the movement required by the spout and a transmission device which acts to transmit the control arm movement to the spout to reproduce it as spout movement, and vice versa.

The control mechanism of the present invention is pivotally connected to an intermediate lever; while the intermediate lever in turn is pivotally connected to one end of the control arm. The intermediate lever together with the control arm form a rotating hinge with a variable angle of opening (i.e., the included angle). It is this angle of opening which determines the angle of inclination of the control arm and that of the spout in relation to the vertical axis of the furnace. The control mechanism of the present invention is designed to cause this "hinge" to rotate about a vertical axis so as to modify its included angle with respect to the vertical axis. The present invention further includes a rotary internal housing supported on a support frame via a bearing member and enclosed by an outer housing or cawl. The rotary housing is associated with a toothed rim which is actuated by a first motor fixed to or adjacent to the support frame.

A control mechanism is also provided which includes a driving rod which is coaxial with the rotary internal housing and which is capable of sliding in the axial direction. The control mechanism is associated with a second motor which is also adjacent to or fixed to the support frame.

A pivotal connecting means consisting of a central body and two diametrically opposed pivots is mounted on the lower end of the driving rod via one or more bearings in such a way so as to be freely rotatable in relation to the driving rod (and in conjunction with the rotary housing), but integral therewith with regard to vertical or axial movement. The pivotal connecting means is associated with the rotary housing such that a high rate of rotation may be transferred thereto. It will be appreciated that the intermediate lever is pivotably connected to the pivotal connecting means by its end opposite that connected to the control arm.

Preferably, the opposite ends of the pivotal connecting means slide in U-shaped grooves provided in diametrically opposite positions along the internal face of the rotary housing. Sliding movement of the pivotal connecting means is preferrably insured by rectangular shoes provided on opposite ends of the pivotal connecting means. Also, in a preferred embodiment of the present invention, the end of the intermediate level which is connected to the pivotal connecting means is constructed in the form of a stirrup, the two branches of the stirrup being engaged by the opposite ends of the pivotal connecting means.

The above discussed and other advantages of the present invention will be apparent to and understood by those skilled in the art by the following detailed description and drawings.

BRIEF DESCRIPTION OF THE DRAWINGS

Referring now to the drawings wherein like elements are numbered alike in the several figures.

DESCRIPTION OF THE PREFERRED EMBODIMENT

Figure 1:
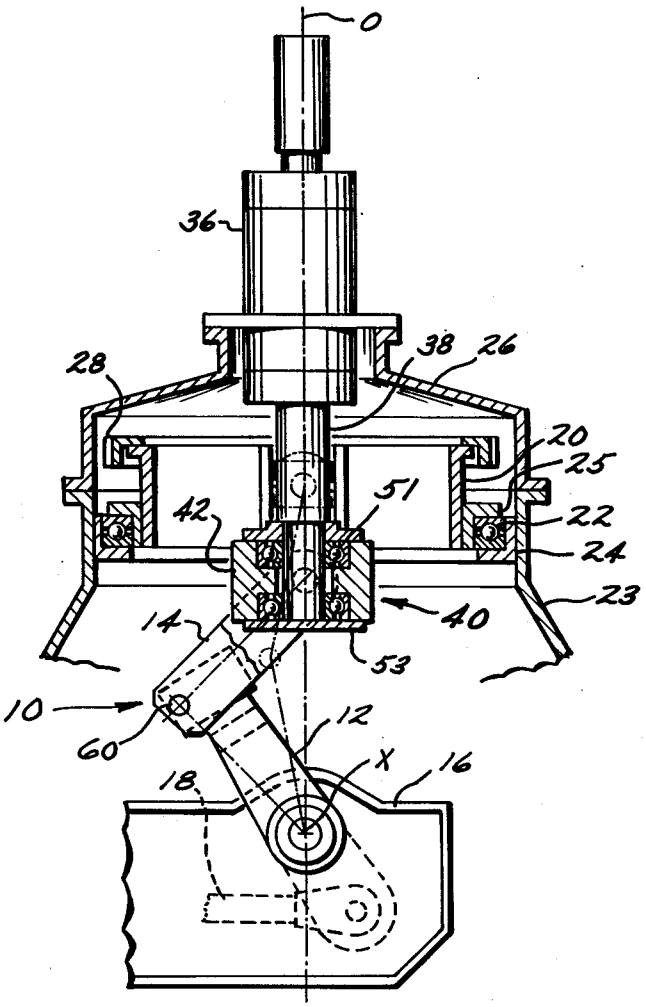
FIG. 1 is front elevation view, partly in cross-section, through a driving apparatus for oscillating spouts in accordance with the present invention.

Referring first to FIG. 1, a "hinge" having a variable "included" angle and capable of turning about a vertical axis 0 is shown generally at 10. Hinge 10 consists of a control arm 12, capable of pivoting about an axis X perpendicular to the plane of the sheet, and of an intermediate lever 14. Control arm 12 is connected by means of an appropriate (and well known) transmission mechanism 16 to a distribution spout (not shown).

Transmission mechanism 16 is preferably of the type described in European patent application 0 062 769, corresponding to U.S. Pat. No. 4,525,120 which is assigned to the assignee hereof, i.e. consisting of a transmission bar 18 (positioned between a pair of spaced levers 19 and 21) actuated by the pivoting control arm 12 with transmission bar 18 performing its movements inside a sealed housing 16 capable of pivoting about its longitudinal axis. It will be appreciated that further details of the transmission mechanism 16 can be found in the aforementioned patent application.

A rotary internal housing 20 which is coaxial with axis 0 is positioned above the hinge 10. Internal housing 20 is supported by a bearing 22 between right angle shoulders 24 and 25 of a support frame 23 and is enclosed by an outer housing or cowl 26. Rotary housing 20 is provided with a toothed rim 28 which is adapted to engage a driving pinion 30 (See FIG. 2). Driving pinion 30 is actuated by a first motor 34, e.g. an electric motor, via a gear box 32. It should be understood that the action of motor 34 causes housing 20 to rotate about central axis 0. It should also be noted that other means for transmitting the rotary action from motor 34 to rotary housing 20 may be used in accordance with the present invention.

A second motor 36 which may be either electrical or hydraulic, is similarly mounted on cowl 26. Motor 36 serves to actuate a driving rod 38 in the axial direction along central axis 0.

A pivotal connecting means 40 consisting of a central body 42 and two diametrically opposed pivots or extensions 44 and 46, is mounted on the lower end of driving rod 38 via one or more bearings 48, 50, between a pair of first and second flange members 51 and 53 in such a way so as to be freely rotatable in relation to rod 38, but integral therewith with regard to vertical or axial movement.

Figure 3:
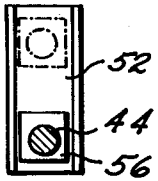
FIG. 3 is an enlarged cross-sectional detailed view of a guide groove of the pivotal connecting means used in conjunction with the driving apparatus in accordance with the present invention.

Pivots 44 and 46 of pivotal connecting means 40 each respectively cooperate with a pair of vertical guide grooves 52, 54, preferably of U-shape and which are provided in diametrically opposed positions on the inner face of rotary housing 20. The operation of guiding pivots 44 and 46 in grooves 52 and 54 can be improved by means of rectangular shoes 56, 58 (see FIG. 3) respectively provided on the ends of the pivots 44 and 46.

Figure 2:
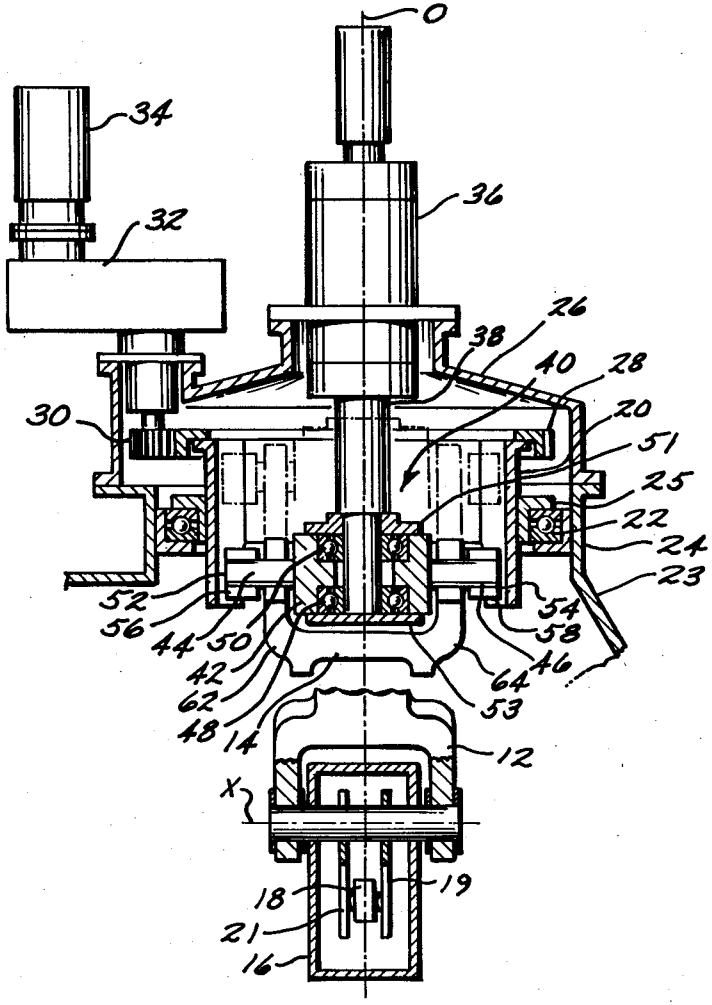
FIG. 2 is a front elevation view, partly in cross-section, of the driving apparatus of FIG. 1 in a direction perpendicular to FIG. 1.

During operation of motor 36, pivotal connecting means 40 can be displaced back and forth between the position shown in full lines and that shown in dot-and-dash lines in FIG. 2. This movement modifies the "included" angle of hinge 10, i.e. causes control arm 12 to pivot about the axis X. It will be appreciated that this variation of the included angle of hinge 10 (under the action of motor 36) may be carried out independently and simultaneously with its rotation about axis 0 as a result of the rotation of rotary housing 20 under the action of motor 34.

Figure 6:
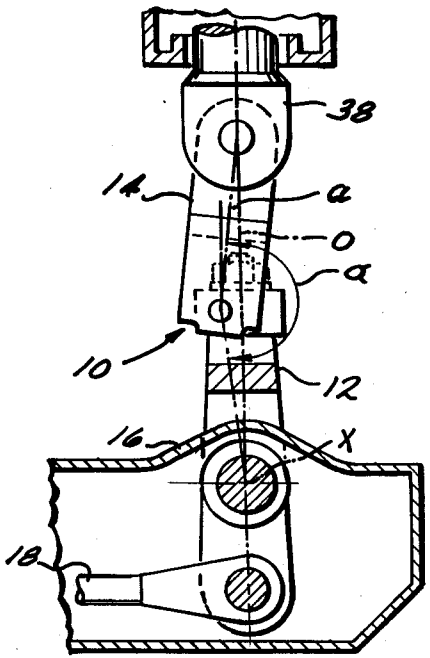
FIG. 6 is a front elevation view of the drive means of FIG. 4 fully opened so that the distribution spout is vertically aligned.
Figure 4:
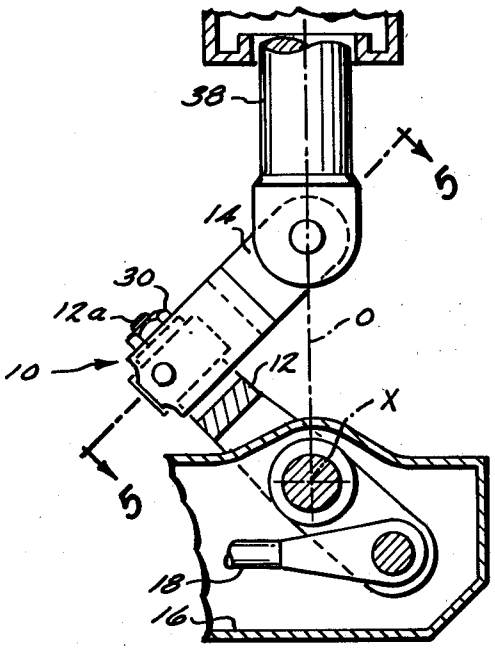
FIG. 4 is a front elevational view of drive means incorporating a universal joint means which is used in conjunction with the present invention.
Figure 5:
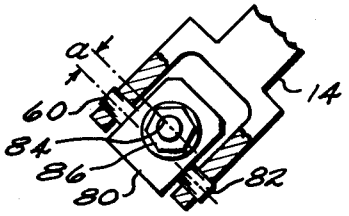
FIG. 5 is a sectional view along the line V—V of FIG. 4.

As shown in FIG. 1, axis 0 of hinge 10 is perferably offset with respect to the longitudinal axis of the control arm 12 to preclude locking in position along the vertical axis 0 when the spout occupies its vertical position. This offset hinge arrangement utilizes a novel universal joint means 60 as shown in FIGS. 4–6. In short, the universal joint means of FIGS. 4–6 includes means to offset the angle of alignment between the control arm and the intermediate lever arm whereby the angle therebetween is less than 180° when the control arm is vertically aligned. The structure which permits this offset means is the way in which the axis of the journals 60 and 82 is offset in relation to the axis of the bore 84 (which corresponds to the longitudinal axis of the control arm 12 as shown in FIG. 5). As seen in FIG. 5, the axis of the journals 60 and 82 is offset by the distance "a" from the axis of bore 84 (and hence from the longitudinal axis of control arm 12).

Referring to FIG. 6, when the spout is positioned vertically (corresponding to a vertical position for arm 12 with the axis of arm 12 aligned with the vertical axis "O"), the axis of the journals 60 and 82 remains at a distance "a" from the axis O. Thus, with the spout in its full vertical position, the angle $\alpha$ of the hinge will be less than 180°. This enables the driving rod 38 to be lowered from the position shown in FIG. 6 to reduce the angle of the hinge 10, i.e., to increase the angle of inclination of the control arm 12 in relation to the axis O and therefore to raise the distributing spout if vertical distribution is not desired.

Thus, a controlled driving means for moving an oscillating spout in and out of a vertical position is achieved without the undesirable locking problem and without the need for external side forces to move the spout from the vertical.

It should be noted that the universal joint used in conjunction with the present invention and illustrated by FIGS. 4–6 will not impede the transmission of the movement of the control arm 12 to the distributing spout. Note also that the friction between the cylindrical head 12*a* and the bore 84 can be reduced by the provision of a bearing.

As is shown in FIG. 2, the connection between intermediate lever 14 and pivotal connecting means 40 is preferably provided by constructing the upper end of lever 14 in the form of a stirrup having two branches 62 and 64 which are respectively connected between pivots 44 and 46 and which serve as pivot means for lever 14. The pivotable connection between control arm 12 and pivot axis X can similarly be provided by constructing the lower portion of arm 12 in the form of a stirrup having two branches straddling the housing 16.

The driving apparatus for oscillating spouts of the present invention is very compact, particularly with regard to the space it occupies in the vertical (i.e., axial) direction. This compact size is achievable because the height of the rotary housing 20 can be reduced to that required for the vertical sliding movement of the pivotal connecting means 40 and for the amplitude of movement of the rod 38. This is a distinct advantage as compared to prior art existing systems (i.e., French Patent Application A-80 13890) wherein the need for resisting and withstanding the high mechanical stresses, particularly the lateral components of the thrust, necessitated a driving device of much greater height in the axial direction.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Apparatus for driving and controlling the movement of an oscillating spout capable of movement about two orthogonal axes under the direction of a control arm having the same degrees of freedom of movement as the spout comprising:

a driving rod capable of axial displacement;

an intermediate lever arm;

pivotal connecting means connecting a first end of said intermediate lever arm to said driving rod;

a control arm to be connecdted to an oscillating spout;

a first end of said control arem being connected to a second end of said intermediate lever arm via joint means;

rotary housing means, said housing means including transmission means associated with first driving means to effect rotation thereof;

said driving rod being coaxial with said rotary housing means and being associated at a first end with second driving means for axial displacement; and said pivotal connecting means engaged via bearing means to a second end of said driving rod wherein said pivotal connecting means is displaced axially with said driving rod, and wherein said pivotal connecting means is associated with said rotary housing means to freely rotate therewith.

2. The apparatus of claim 1 wherein said transmission means includes:

a toothed rim associated with said rotary housing means; and pinion means associated with said first driving means, said pinion means adapted to engage said toothed rim to rotate said rotary housing means.

3. The apparatus of claim 1 including:

outer housing means enclosing said rotary housing means.

4. The apparatus of claim 1 wherein said pivotal connecting means comprises:

a main body portion;

a pair of pivots oppositely disposed of said body portion, said pivots being pivotably connected to said intermediate lever arm.

5. The apparatus of claim 1 including:

a pair of oppositely disposed grooves along the interior surface of said rotary housing means, said grooves being parallel to said longitudinal axis; and wherein opposite ends of said pivotal connecting means slide in said grooves.

6. The apparatus of claim 4 including:

a pair of oppositely disposed grooves along the interior surface of said rotary housing means, said grooves being parallel to said longitudinal axis; and wherein said pivots of said pivotal connecting means slide in said grooves.

7. The apparatus of claim 5 wherein said grooves have a U-shape.

8. The apparatus of claim 6 wherein said grooves have a U-shape.

9. The apparatus of claim 5 wherein said opposite ends of said pivotal connecting means include:

rectangular shoes, said rectangular shoes being disposed in said grooves.

10. The apparatus of claim 6 wherein said opposite ends of said pivotal connecting means include:

rectangular shoes, said rectangular shoes being disposed in said grooves.

11. The apparatus of claim 7 wherein said opposite ends of said pivotal connecting means include:

rectangular shoes, said rectangular shoes being disposed in said grooves.

12. The apparatus of claim 8 wherein said opposite ends of said pivotal connecting means include:

rectangular shoes, said rectangular shoes being disposed in said grooves.

13. The apparatus of claim 1 wherein:

said first end of said intermediate lever arm is formed as a stirrup having a pair of branches; and wherein said opposite ends of said pivotal connecting means is pivotably connected between said branches.

14. The apparatus of claim 4 wherein:

said first end of said intermediate lever arm is formed as a stirrup having a pair of branches; and wherein said pivots of said pivotal connecting means is pivotably connected between said branches.

15. The apparatus of claim 1 wherein:

said joint means comprises universal joint means; and wherein said universal joint means includes means to offset the angle of alignment between said control arm and said lever arm wherein the angle therebetween is less than 180° when said control arm is vertically aligned with said lever arm.

* * * * *